US008378263B2

(12) United States Patent
Biegelsen et al.

(10) Patent No.: US 8,378,263 B2
(45) Date of Patent: Feb. 19, 2013

(54) HYBRID MULTI-ZONE FUSING

(75) Inventors: David K. Biegelsen, Portola Valley, CA (US); Lars Erik Swartz, Sunnyvale, CA (US); Armin R. Volkel, Mountain View, CA (US); Ashish V. Pattekar, San Mateo, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1152 days.

(21) Appl. No.: 12/250,322

(22) Filed: Oct. 13, 2008

(65) Prior Publication Data

US 2010/0092199 A1 Apr. 15, 2010

(51) Int. Cl.
*G03G 15/20* (2006.01)

(52) U.S. Cl. ..... 219/216; 219/388; 399/69; 399/336

(58) Field of Classification Search ..... None
See application file for complete search history.

(56) References Cited

U.S. PATENT DOCUMENTS

| | | | | |
|---|---|---|---|---|
| 4,242,091 | A * | 12/1980 | Feess et al. | 8/444 |
| 4,833,301 | A * | 5/1989 | Furtek | 219/388 |
| 5,983,063 | A * | 11/1999 | De Niel et al. | 399/335 |
| 6,067,437 | A * | 5/2000 | Schonfeld | 399/320 |
| 6,993,278 | B2 * | 1/2006 | Bartscher et al. | 399/322 |
| 7,801,475 | B2 * | 9/2010 | Biegelsen et al. | 399/335 |
| 7,890,043 | B2 * | 2/2011 | Biegelsen et al. | 399/335 |
| 2002/0136574 | A1 * | 9/2002 | Bartscher et al. | 399/336 |
| 2007/0280758 | A1 * | 12/2007 | Ciaschi et al. | 399/336 |
| 2008/0150229 | A1 | 6/2008 | Biegelsen et al. | |
| 2009/0154968 | A1 * | 6/2009 | Biegelsen et al. | 399/335 |
| 2009/0154969 | A1 * | 6/2009 | Biegelsen et al. | 399/335 |
| 2009/0274499 | A1 * | 11/2009 | Kovacs et al. | 399/335 |

FOREIGN PATENT DOCUMENTS

DE 2658863 B * 4/1978

* cited by examiner

*Primary Examiner* — Joseph M Pelham
(74) *Attorney, Agent, or Firm* — Marger Johnson & McCollom, P.C.

(57) ABSTRACT

A fusing system and a method of operating the fusing system, including a first heating zone to heat marking material and a substrate using a non-condensing heat source to less than a target temperature; and a second heating zone to heat the marking material and the substrate to about the target temperature to fuse the marking material to the substrate.

17 Claims, 4 Drawing Sheets

HYBRID MULTI-ZONE FUSING

BACKGROUND

This disclosure relates to fusing of marking material to a substrate and, in particular, the fusing of marking material to a substrate through multi-zone fusing.

Contactless fusing often uses steam to transfer heat to marking material on a substrate to fuse the marking material to the substrate. However, during the heat transfer process, significant amounts of water can be deposited due to condensation, causing various problems. For example, the substrate can become dimensionally unstable through water entering the substrate and allowing hygroexpansive stress relaxation. In addition, the water that condensed on and entered the substrate can subsequently vaporize after a marking material skin has formed, resulting in bubbling and bursting. Furthermore, as more water condenses on the substrate, a portion of that water must again be vaporized so that the temperature of the substrate can rise above the boiling point. As a result, more energy and/or time is required for processing.

SUMMARY

An embodiment includes a fusing system including a first heating zone to heat marking material and a substrate using a non-condensing heat source to less than a target temperature; and a second heating zone to heat the marking material and the substrate to about the target temperature to fuse the marking material to the substrate.

Another embodiment includes a method of fusing marking material to a substrate including increasing a temperature of the substrate in a first heating zone such that the temperature of the substrate is less than or equal to a target temperature; and holding the substrate substantially at the target temperature in a second heating zone.

DETAILED DESCRIPTION

Embodiments include multi-zone fusing systems which preheat a substrate prior to being heated by a vapor. Use of a steam oven architecture with only one zone of steam at a temperature of ~180° C.+/−20° C. leads to the build-up of a condensed liquid water layer on the substrate and heating of the substrate to 100° C. in ~100 ms followed by ~1 second during which the liquid layer is re-evaporated and before the substrate can be heated above 100° C. If the time in the steam oven needs to be long compared to the heating time (e.g. to allow capillary reflow of molten toner to achieve desired gloss in fusing applications), excessive drying of the native moisture content of the substrate can occur. However, the initial liquid water build-up on the surface can lead to capillary infusion of the water into the bulk of the substrate and result in cockling due to inter-fiber lubrication. Once the cockling appears, subsequent drying of the paper is not effective in reversing the distortion. It is thus desirable to have independent controls so that the substrate can be heated rapidly without building up an appreciable thickness of water on the surface (minimizing 'condensation zone' time in the steam oven and minimizing cockle) yet allowing the substrate to be subsequently held at a desired temperature with minimal reduction in moisture content. A first zone of ultra-heated steam heats the substrate by condensation and simultaneously partially re-evaporates the condensed water by convective heat transfer. The 'ultra-heated steam' is maintained at a temperature sufficient to enable the high convective heat transfer rates needed to re-evaporate the liquid water condensing on the substrate surface and control the net amount of water accumulation. Minimization of the build-up minimizes infusion into the substrate and thus cockling. It further shortens the time to take the substrate above the boiling point of the water and to the approximate holding temperature required for the subsequent process step(s) such as toner reflow for glossing. A second zone is then entered in which the substrate is held at the desired elevated temperature. Holding the substrate at the minimum required temperature minimizes the evaporation of moisture from the substrate.

Figure 1:
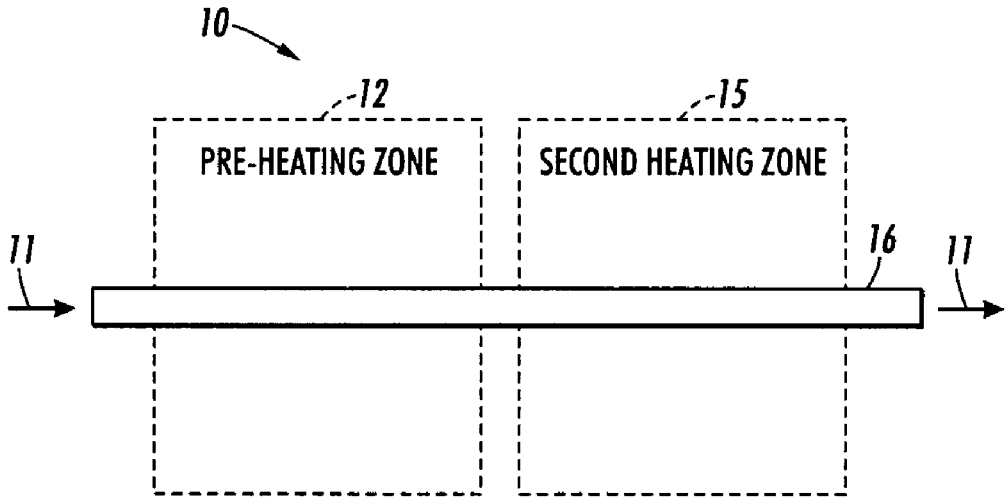
FIG. 1 is a block diagram of a multi-zone fusing system according to an embodiment.

FIG. 1 is a block diagram of a multi-zone fusing system according to an embodiment. The fusing system 10 includes a first heating zone 12 and a second heating zone 15. In this embodiment, the first heating zone 12 can be referred to as a pre-heating zone 12. The pre-heating zone 12 is configured to heat marking material and a substrate 16 to less than about a target temperature. The target temperature can be a temperature at which the substrate 16 is held to fuse the marking material to the substrate 16.

As used in this description, a marking material can include a variety of different materials. For example, marking material can include toners, gels, wax based materials, or the like. Any marking material that can be fused to a substrate can be used.

In an embodiment, the second heating zone 15 is a vapor heating zone. That is, the second heating zone 15 is configured to transfer heat to the substrate 16 using a vapor. In a particular example, the vapor of the second heating zone 15 can be steam. The target temperature can be above the boiling temperature of water. In other embodiments, other vapors can be used. For example, an alcohol vapor can be used. Any vapor compatible with the marking material and substrate 16 can be used.

Examples of the pre-heating zone 12 will be described in further detail below. In particular, the pre-heating zone 12 can increase a temperature of the substrate 16 partially to the target temperature. After passing through the pre-heating zone 12, the substrate 16 can enter the second heating zone 15. The second heating zone 15 is configured to heat the marking material and the substrate 16 to about the target temperature to fuse the marking material to the substrate. The second heating zone 15 can also be configured to allow proper reflow and leveling for gloss formation and/or other desirable characteristics which may require a longer dwell time to achieve than is required just to heat to temperature. That is, the heating of the marking material and the substrate 16 can also include holding the marking material and substrate 16 at about the target temperature. Accordingly, a portion of the heating of the substrate 16 can be performed in the pre-heating zone 12 and the remainder of the heating and/or holding of the substrate 16 at the target temperature can be performed in the second heating zone 15.

In an embodiment, the pre-heating zone 12 can be a non-condensing heating zone. That is, the heat transfer substantially occurs through a process other than heat transfer through condensation. For example, heating zones using radiation, convection, or even heating using a vapor with a boiling point less than the initial temperature of the substrate when it enters the pre-heating zone 12 can be considered a non-condensing heating zone. This does not mean that no heating can occur through condensation; rather that at least the majority of the heat transfer occurs without condensation.

In another embodiment, the pre-heating zone 12 can be a contactless heating zone. That is, the heat transfer substantially occurs through a process other than through direct contact of a heat source to the marking material and substrate 16. This does not mean that no heat transfer can occur through the direct contact; rather that at least the majority of the heat transfer does not occur through direct contact.

As the second heating zone 15, which heats using vapor, is used to add a smaller amount of energy to the substrate 16, a smaller amount of the vapor will condense on the substrate 16, reducing the impact of condensed vapor. Using the steam heating in the second heating zone 15 as an example, a smaller amount of water will be deposited and/or infiltrate the substrate 16. As a result, fusing defects due to the additional water can be reduced.

Arrows 11 indicate a direction of travel of the substrate 16 through the heating zones 12 and 15. Although not illustrated, the fusing system 10 can include a variety of substrate conveyance systems as desired. For example, star wheels, rollers, or the like as described in U.S. Patent Application Publication No. 20080150229 can guide the substrate 16 through the heating zones 12 and 15. In another example, the substrate 16 can have tension applied to guide the substrate 16. Any technique of moving the substrate 16 can be used.

Figure 2:
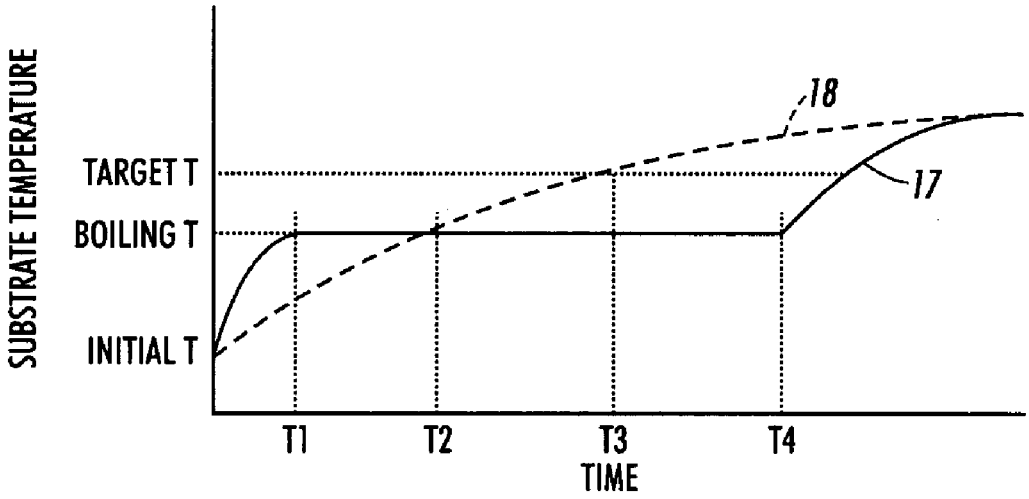
FIG. 2 is a graph illustrating a temperature of a substrate in various environments.

FIG. 2 is a graph illustrating a temperature of a substrate in various environments. In particular, curve 17 illustrates a substrate held in a water vapor atmosphere while curve 18 illustrates a substrate in a radiant heating zone, for example. The substrates begin at the same initial temperature. Curve 17 rises quickly to the boiling temperature at time T1 due to the condensation of the water vapor and accompanying transfer of heat. In contrast, curve 18 has risen to a lower temperature than the boiling temperature by time T1.

After time T1, as illustrated by curve 17, the heat transferred to the substrate is used to overcome the latent heat of vaporization of water in the substrate. In particular, energy must be transferred to the water that condensed on the substrate. As a result, the temperature of the substrate remains at the boiling temperature until time T4 while the additional energy is added.

In contrast, as curve 18 illustrates a heating technique that does not rely on the condensation of a vapor for a substantial amount of heating, after time T1, the temperature continues to increase. Eventually, by time T3, the temperature of the substrate has risen to be equal to the boiling temperature. As there is substantially less energy used in overcoming the latent heat of vaporization, the temperature of curve 18 can continue to rise.

As a result, the substrate with the temperature of curve 18 can rise to the target temperature at time T3. In contrast, the substrate in the water vapor atmosphere does not reach the target temperature until after time T4. As a result, a heating zone that does not use heat transfer from the condensation of a vapor can rise faster to a target temperature. Arriving at the target temperature faster can lead to greater throughput, reduced size, reduced power consumption, or the like, as less time and/or space is needed to raise the temperature of the substrate.

Figure 3:
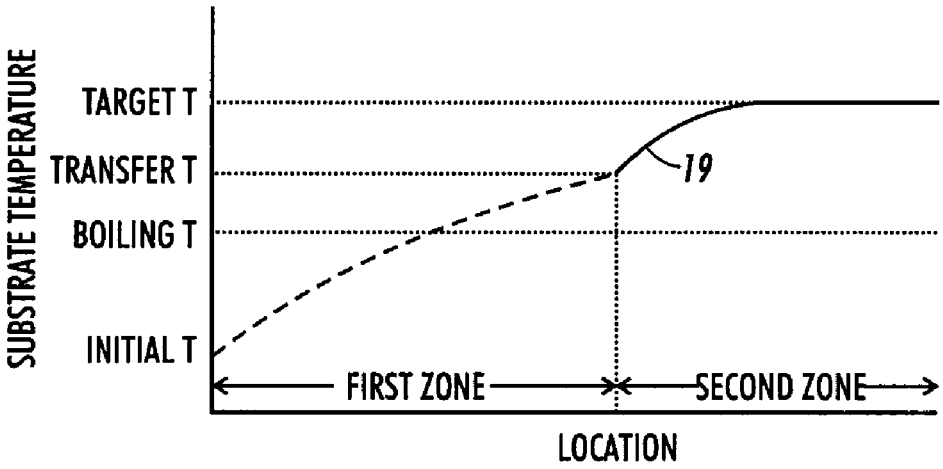
FIG. 3 is a graph illustrating a temperature of a substrate passing through a multi-zone fusing system according to an embodiment.

FIG. 3 is a graph illustrating a temperature of a substrate passing through a multi-zone fusing system according to an embodiment. Curve 19 illustrates the temperature of the substrate. The substrate enters the first heating zone at an initial temperature. The boiling temperature indicated on the graph is the boiling temperature of a vapor in the second heating zone. In this embodiment, the boiling temperature is less than the target temperature. As the substrate passes through the first heating zone, the temperature of the substrate rises past the boiling temperature of a vapor in the second heating zone to the transfer temperature.

As the substrate enters the second heating zone above the boiling temperature, heat is not transferred to the substrate due to condensation. For example, in a water vapor atmosphere, water will not condense on the substrate. As a result, any hygroexpansive stress relaxation, bubbling, bursting, or the like will be eliminated or have a reduced effect due to the reduced amount of water condensing on the substrate. Once transferred to the second heating zone, the temperature of the substrate can be increased to the target temperature and/or the substrate can be held at the target temperature. As described above, using the transfer temperature as the target temperature of FIG. 2, the substrate can be brought to the transfer temperature faster than in a vapor atmosphere. Accordingly the fusing time can be reduced.

Figure 4:
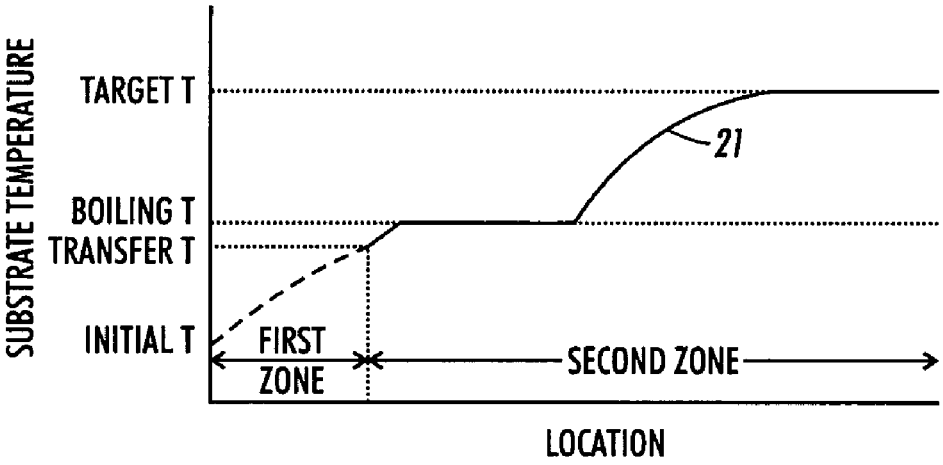
FIG. 4 is a graph illustrating a temperature of a substrate passing through a multi-zone fusing system according to another embodiment.

FIG. 4 is a graph illustrating a temperature of a substrate passing through a multi-zone fusing system according to another embodiment. In this embodiment, the first heating zone can heat the temperature of the substrate to less than the boiling temperature of the vapor in the second heating zone. Thus, when the substrate is transferred to the second heating zone, the substrate temperature is less than the boiling temperature of the vapor. Accordingly, some heating of the substrate will be due to condensation of the vapor on the substrate. However, since the rise in the temperature of the substrate from the initial temperature was not entirely within the vapor atmosphere, a reduced amount of condensation of the vapor will have occurred. Thus, the amount of liquid deposited on the substrate is reduced relative to the case of heating entirely within a vapor atmosphere. Although reduced, an amount of liquid can still be deposited and enter the substrate. Such an arrangement can be beneficial in reducing the evaporative dehydration of the substrate during its dwell in the second heating zone. Moreover, by controlling the amount of the liquid deposited by controlling the temperature of the substrate when transferred to the second heating zone, the amount of liquid added to reduce the effects of evaporative dehydration can be controlled.

Figure 5:
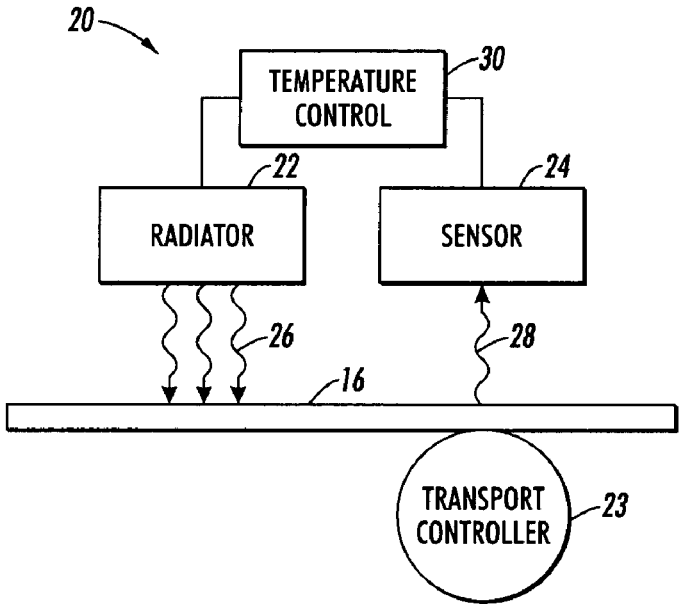
FIG. 5 is a block diagram of an example of a heating zone of the multi-zone fusing system of FIG. 1.

FIG. 5 is a block diagram of an example of a heating zone of the multi-zone fusing system of FIG. 1. In this embodiment, the heating zone is a radiant heating zone 20 that can be used as the first heating zone 12 of FIG. 1. The radiant heating zone 20 can include a radiator 22. The radiator 22 is configured to radiate energy 26 towards the substrate 16. As a result, the temperature of the substrate 16 can rise to the transfer temperature as described above.

The radiator 22 can be configured to radiate a variety of types of energy. For example, the radiator 22 can radiate infrared energy, microwave energy, or the like. Examples of radiators 22 include quartz lamps, graphite heaters, infrared reflectors, or the like. In addition, the radiator 22 can, but need not continuously radiate energy. For example, the radiator 22 can emit pulses of energy as the energy 26. Moreover, any energy source that can be used in a flash fusing system can be used as the radiator 22.

Although the radiator 22 has been illustrated on one side of the substrate 16, the radiator 22 can be configured to radiate energy 26 to both sides, or only to the other side of the substrate 16. Moreover, when the substrate 16 is radiated from both sides, the amount of radiation incident on the sides can, but need not be equal.

In an embodiment, the radiant heating zone 20 can include a sensor 24. The sensor is configured to sense a temperature of the substrate 16. For example, the sensor 24 can sense black body radiation 28 emitted from the substrate 16 to measure the temperature. In another embodiment, direct contact between the sensor 24 and the substrate 16 can be used to measure the temperature.

Regardless of how the temperature is measured, the information can be supplied to temperature control circuitry 30. The temperature control circuitry 30 can be coupled to the radiator 22 and configured to adjust the energy 26 emitted towards the substrate in response to signals from the sensor 24. In an embodiment, this control can make the heating in the radiant heating zone 20 more tolerant of variations in the substrate 16, marking material, or the like. For example, substrate 16 having different colors, different colored marking materials applied, different textures, different reflectivity, or the like can have different levels of absorption of the energy 26 from the radiator 22. As the sensor 24 senses the absorbed energy through sensing the temperature of the substrate 16, the radiator 22 can be controlled such that the temperature of the substrate 16 is substantially uniform as it exits the radiant heating zone 20, regardless of the variation in substrate, marking material, or the like. Accordingly, reconfiguration for runs with different substrates and/or marking materials is not necessary.

In another embodiment, the radiant heating zone 20 can include a transport controller 23 coupled to the temperature control circuitry 30. The transport controller 23 can include star wheels, rollers, tensioning, or the like as described above, and associated circuitry to move the substrate 16 at a transport speed. The transport controller 23 can be configured to adjust the transport speed based upon the sensed temperature. As a result, the dwell time within the radiant heating zone 20 can be controlled to control the heat transfer to the substrate 16.

Although the radiator 22 and transport controller 23 have been described as being separately controlled by the temperature control circuitry, the radiator 22 and transport controller 23 can both be responsive to the temperature control circuitry 30. For example, if the temperature of the substrate 16 is sensed as being too high, the energy 26 from the radiator 22 can be reduced and the transport speed can be increased by the transport controller 23. Accordingly, less energy will be transferred to a unit area of the substrate 16, reducing its temperature.

Furthermore, although the transport controller 23 has been described as being part of the radiant heating zone 20, the transport controller 23 can be partially and/or wholly outside of the radiant heating zone 20. For example, the substrate 16 can be tensioned by rollers outside of both the radiant heating zone 20 and the second heating zone 15. The adjustment of the transport controller 23 can include the adjustment of controls for such rollers. Accordingly, the transport controller 23, regardless of the type of heating zone, can be implemented as part of a heating zone, separate from the heating zone, or a combination of such implementations.

As described above, the sensor 24 can be part of the radiant heating zone 20. In another embodiment, the sensor 24 can be part of the second heating zone 15. For example, the sensor 24 can be located at an entrance to the second heating zone 15. As a result, the temperature of the substrate 16 at the entrance to the second heating zone 15 can be controlled to accommodate for any changes in temperature between the radiant heating zone 20 and the second heating zone 15. For example, any cooling between the radiant heating zone 20 and the second heating zone 15 can be compensated through the control of the radiator 22. Accordingly, the sensor can be located anywhere substantially between the heating zones, including within each heating zone.

Figure 6:
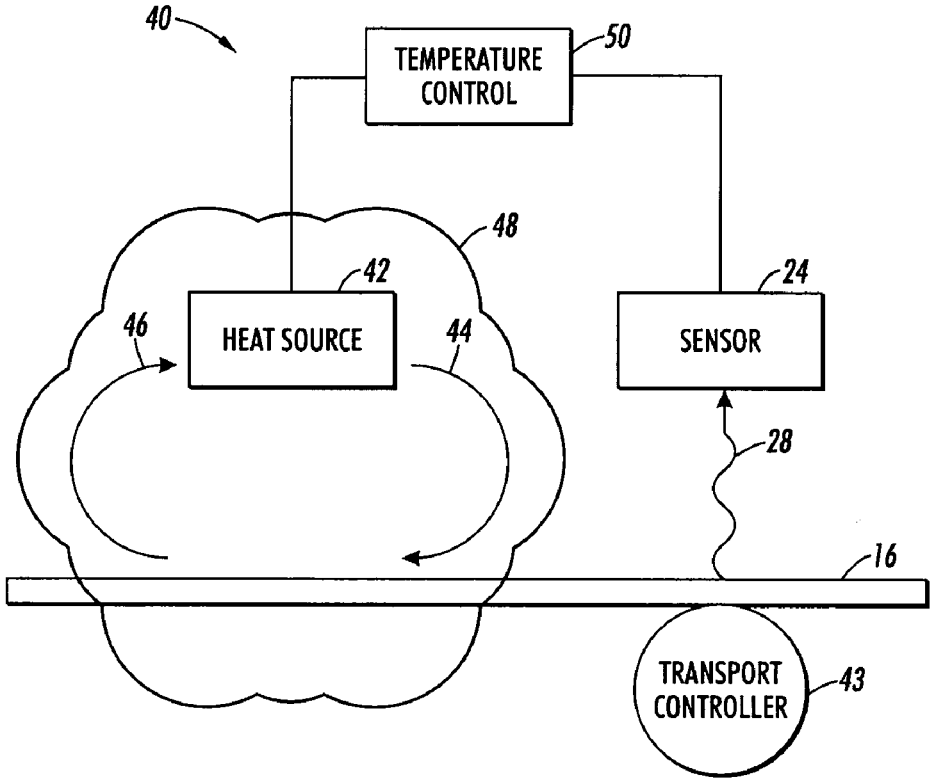
FIG. 6 is a block diagram of another example of a heating zone of the multi-zone fusing system of FIG. 1.

FIG. 6 is a block diagram of another example of a heating zone of the multi-zone fusing system of FIG. 1. In this embodiment, the pre-heating zone 12 is a convective heating zone 40. The convective heating zone 40 includes a heat source 42. The heat source 42 is configured to heat an atmosphere 48 surrounding the substrate 16.

The heat source 42 can be any variety of heat sources. For example, the heat source 42 can be an electric heat source, a combustion heat source, a chemical heat source, heat pump, or the like. Moreover, the heat source 42 can, but need not be a self contained heat source. For example, the heat source 42 can be a heat exchanger to exchange heat between the atmosphere 48 and a media heated in a different location. Any device that can add heat to the atmosphere 48 can be a heat source 42.

In this embodiment, the heat source 42 circulates the atmosphere 48. Incoming atmosphere 46 is heated and exhausted atmosphere 44 is directed towards the substrate. The heat source 42 can include fans, ducting, baffles, or the like to move and/or guide the atmosphere 48 through the heat source 42 and back towards the substrate 16. Although the heat source 42 has been described as circulating the atmosphere 48, the atmosphere 48 can, but need not heat the existing atmosphere 46. In contrast, the heat source 42 can heat an atmosphere from an external source. Thus, the heat source 42 may only supply heated atmosphere 44.

Similar to the radiant heat source 20 of FIG. 5, the convective heat source 40 can include a sensor 24 and a temperature control circuitry 50. The sensor 24 can sense the temperature of the substrate 16. The temperature control circuitry 50 can control the heat source 42 to adjust the temperature of the atmosphere 48. As a result, the temperature of the substrate 16 can be controlled.

Moreover, the convective heat source 40 can include a transport controller 43 similar to the transport controller 23 of FIG. 5. The transport controller 43 can be adjusted in response to the sensed temperature of the substrate 16. Accordingly, the temperature of the substrate 16 can be controlled as desired.

Figure 7:
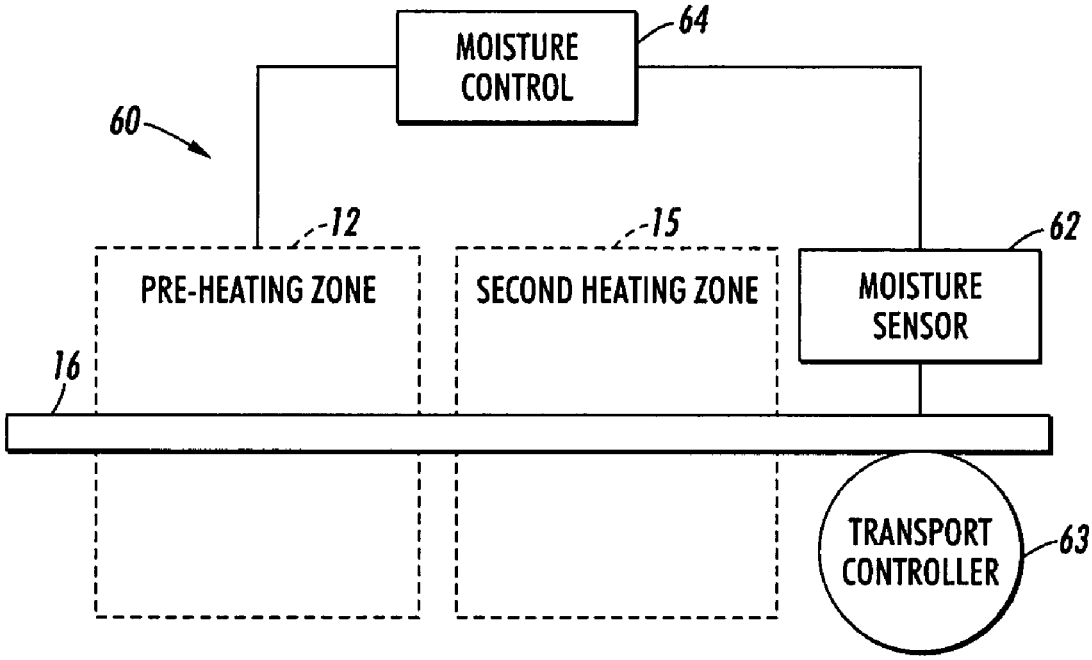
FIG. 7 is a block diagram of a moisture control system in a multi-zone fusing system according to an embodiment.

FIG. 7 is a block diagram of a moisture control system in a multi-zone fusing system according to an embodiment. As described above, additional moisture from the condensation of vapor on the substrate 16 can lead to fusing defects. However, in the process of pre-heating, an amount of moisture can be removed from the substrate 16, or an amount that would have been added through condensation was not, such that the moisture level of the substrate 16 is less than desired. Accordingly, the substrate 16 can become less pliable, contract, cockle, or otherwise distort.

However, as illustrated in FIG. 7, the fusing system 60 can include a moisture control system. For example, a moisture sensor 62 can sense a moisture level of the substrate 16 as it exits the second heating zone 15. The sensed moisture level can be provided to a moisture control circuitry 64. In response, the moisture control circuitry 64 can adjust the heating of the pre-heating zone 12, the dwell time in the pre-heating zone 12 through transport controller 63, a combination of such adjustments, or the like.

In an embodiment, the temperature at which the substrate 16 exits the pre-heating zone 12 can be controlled by the moisture control circuitry 64. For example, as the temperature of the substrate 16 exiting the pre-heating zone 12 increases, the amount of vapor that condenses on the substrate 16 in the second heating zone 15 decreases, leading to a lower moisture content in the substrate 16. Thus, the moisture content of the substrate 16 is dependent on the exit temperature after the pre-heating zone 12. Accordingly, the exit temperature can be controlled so that the moisture content can be set as desired.

Although the moisture sensor 62 has been described as being at an exit of the second heating zone 15, the moisture sensor 62 can be placed in a variety of locations. For example, the moisture sensor 62 can be placed substantially between the pre-heating zone 12 and the second heating zone 15. In another example, the moisture sensor 62 can be placed beyond an exit of the second heating zone 15 to accommodate any moisture change from subsequent processing of the substrate 16.

In an embodiment, the fusing system can include means for increasing a temperature of the substrate in a first heating zone such that the temperature of the substrate is less than or equal to a target temperature; means for transferring the substrate to a second heating zone; and means for holding the substrate substantially at the target temperature in the second heating zone. The means for increasing the temperature of substrate in the first heating zone can include any of the above described first heating zones 12. Similarly, the means for holding the substrate substantially at the target temperature can include any of the above described second heating zones 15. The means for transferring the substrate to the second heating zone can include any variety of substrate conveyance systems as described above.

In another embodiment, the fusing system can include means for sensing energy emitted from an area of the substrate substantially between the first heating zone and the second heating zone; and means for adjusting heating of the first heating zone in response to the sensed energy. The means for sensing energy can include any of the above described sensors 24. The means for adjusting heating of the first heating zone can include any of the above control circuitry, such as the temperature control circuitry 30 and 50.

In another embodiment, the fusing system can include means for measuring a moisture content of the substrate after the substrate exits the second heating zone; and means for adjusting the increase of the temperature in the first heating zone in response to the measured moisture content. The means for measuring the moisture can include the moisture sensor 62 described above. The means for adjusting increase of the temperature can include the moisture control circuitry 64 described above.

Although particular embodiments have been described, it will be appreciated that the principles of the invention are not limited to those embodiments. Variations and modifications may be made without departing from the principles of the invention as set forth in the following claims.

What is claimed is:

1. A fusing system comprising:

a first heating zone to heat marking material and a substrate using a heat source that transfers heat by radiation or convection to less than a target temperature;

a second heating zone to heat the marking material and the substrate to the target temperature to fuse the marking material to the substrate;

a moisture sensor to sense a moisture level of the substrate at an exit of the second heating zone; and control circuitry to control a temperature of the substrate at a transition between the first heating zone and the second heating zone in response to the sensed moisture level.

2. The fusing system of claim 1, wherein the first heating zone is a radiant heating zone.

3. The fusing system of claim 2, wherein the radiant heating zone comprises:

a radiator to radiate energy towards the substrate;

a sensor to sense a temperature of the substrate; and control circuitry coupled to the radiator and the sensor, the control circuitry to adjust the energy emitted towards the substrate in response to the sensed temperature of the substrate.

4. The fusing system of claim 1, further comprising:

a transport controller to control a transport speed of the substrate;

a sensor to sense a temperature of the substrate; and control circuitry coupled to the sensor and the transport controller, the control circuitry to adjust the transport speed in response to the sensed temperature of the substrate.

5. The fusing system of claim 1, wherein the first heating zone is a convective heating zone.

6. The fusing system of claim 5, wherein the convective heating zone comprises:

a heat source to heat an atmosphere surrounding the substrate;

a sensor to sense a temperature of the substrate; and control circuitry coupled to the heat source and the sensor, the control circuitry to adjust a temperature of the atmosphere in response to the sensed temperature of the substrate.

7. The fusing system of claim 1, wherein the second heating zone is configured to heat the marking material and the substrate using a vapor having a boiling temperature less than the target temperature.

8. The fusing system of claim 7, wherein the first heating zone is configured to heat the marking material and the substrate to a temperature less than the boiling temperature of the vapor.

9. The fusing system of claim 7, wherein the first heating zone is configured to heat the marking material and the substrate to a temperature greater than the boiling temperature of the vapor.

10. A method of fusing marking material to a substrate, comprising:

increasing a temperature of the substrate in a first heating zone using a non-condensing heat source that transfers heat by radiation or convection such that the temperature of the substrate is less than or equal to a target temperature;

holding the substrate substantially at the target temperature in a second heating zone;

measuring a moisture content of the substrate after the substrate exits the second heating zone; and adjusting the increase of the temperature in the first heating zone in response to the measured moisture content.

11. The method of claim 10, further comprising emitting energy towards the substrate.

12. The method of claim 10, further comprising:

sensing energy emitted from an area of the substrate substantially between the first heating zone and the second heating zone; and adjusting heating of the first heating zone in response to the sensed energy.

13. The method of claim 10, wherein:

holding the substrate substantially at the target temperature in the second heating zone comprises holding the substrate in a vapor atmosphere; and increasing the temperature of the substrate in the first zone comprises increasing the temperature of the substrate to less than a boiling temperature of the vapor of the atmosphere.

14. The method of claim 10, wherein:

the vapor atmosphere is a steam atmosphere; and increasing the temperature of the substrate in the first zone further comprises increasing the temperature of the substrate to less than the boiling point of water.

15. The method of claim 10, wherein:

holding the substrate substantially at the target temperature in the second heating zone comprises holding the substrate in a vapor atmosphere; and increasing the temperature of the substrate in the first zone comprises increasing the temperature of the substrate to greater than a boiling point of the vapor of the atmosphere and less than the target temperature.

16. A fusing system, comprising:

means for increasing a temperature of a substrate in a first heating zone such that the temperature of the substrate is less than or equal to a target temperature;

means for transferring the substrate to a second heating zone;

means for holding the substrate substantially at the target temperature in the second heating zone;

means for measuring a moisture content of the substrate after the substrate exits the second heating zone; and means for adjusting the increase of the temperature in the first heating zone in response to the measured moisture content.

17. The fusing system of claim 16, further comprising:

means for sensing energy emitted from an area of the substrate substantially between the first heating zone and the second heating zone; and means for adjusting heating of the first heating zone in response to the sensed energy.

* * * * *